US005709125A

United States Patent [19]

Nakazawa et al.

[11] Patent Number: 5,709,125

[45] Date of Patent: Jan. 20, 1998

[54] PUNCH DRIVE APPARATUS

[75] Inventors: Hiromu Nakazawa, Tokorozawa; Yasuhiko Hukami, Nishikasugai-gun, both of Japan

[73] Assignee: Murata Kikai Kabushiki Kaisha, Kyoto, Japan

[21] Appl. No.: 523,816

[22] Filed: Sep. 6, 1995

[30] Foreign Application Priority Data

Oct. 3, 1994 [JP] Japan ..... 6-264632

[51] Int. Cl.[6] ..... B21J 9/18

[52] U.S. Cl. ..... 72/451; 100/283; 100/289

[58] Field of Search ..... 72/450, 451; 100/289, 100/283

[56] References Cited

U.S. PATENT DOCUMENTS 4,956,992 9/1990 Undin ..... 72/451

5,289,096 2/1994 Takeda ..... 100/289

*Primary Examiner*—David Jones

*Assistant Examiner*—John Paradiso

*Attorney, Agent, or Firm*—Armstrong, Westerman, Hattori, McLeland & Naughton

[57] ABSTRACT

A toggle type punch drive apparatus having a strong output obtained by a simple structure so arranged that it drives a freely movable ram (1) used in punch driving. This toggle system (6) incorporates a first lever (11) that is linked to one end of the ram (1) so as to be freely rotatable, and a second lever (12) that is linked to the other end of the first lever (11) between its base end and free end so as to be freely rotatable and which is freely supported at the base end. The free end of that second lever (12) is linked to a nut (8b) of the feed screw apparatus (8) which is driven by a servomotor (7).

3 Claims, 2 Drawing Sheets

PUNCH DRIVE APPARATUS

FIELD OF THE INVENTION

This invention relates to a punch drive apparatus for a turret punch press which drives a ram by a toggle system.

BACKGROUND OF THE INVENTION

Previous mechanical type punch presses transmitted the rotation of a flywheel which rotated at a fixed speed to a crank system via a clutch brake and then converted this to a lifting movement of a ram. The speed could not be changed mid-stroke.

However, the punch speed greatly affects the noise level of the machine. Consequently, from the point of noise prevention and high speed punching, it is preferable to provide a control that changes the punch speed mid-stroke, that is, a control that makes the speed when the punch tool is actually striking the sheet metal different from the speed of other portions of the stroke.

This kind of punch speed control has been accomplished with a hydraulic punch press but hydraulic punch presses are more costly due to the need for hydraulic systems. Even with mechanical punch presses, control of the punch speed is possible if they are driven by servomotors but it is difficult to hit the sheet metal directly by the power of the servomotor.

Therefore, in order to supplement this striking power, the inventor herein has proposed using a toggle system as a power increasing system by the use of the drive source of the servomotor, e.g. Japanese Patent Application Hei 6-157971.

However, in order to transmit the motor rotation to the toggle system, the intervention of a crank system and movement lever are necessary. Consequently this creates the problem of high costs due to the complexity of the system.

SUMMARY OF THE INVENTION

It is a primary object of this invention to provide a toggle-type punch drive apparatus which can obtain a high output by a simple system.

This invention will be explained in connection with FIG. 1 which corresponds with the embodiments. This punch drive apparatus comprises a freely moveable ram (1) for the punch drive, a first lever (11) to which one end of the ram (1) is freely pivotably linked, a second lever (12) to which is freely pivotably linked the other end of the first lever (11) intermediate the base end and the free end of such second lever, the second lever being pivotably supported by its base end, and a movement drive apparatus (9) which causes the free end of the second lever (12) to pivot differentially.

It is preferable to combine the aforementioned movement drive apparatus (9) with a servomotor (7) and feed screw apparatus (8). The screw shaft (8*a*) of the feed screw apparatus (8) is connected to the servomotor (7) and is linked to the free end of the second lever (12) by the nut (8*b*).

Also, it is preferable for there to be a device in the form of a movement amount alteration means (23) which changes the amount of movement of the aforementioned movement drive apparatus (9). In the case where the movement drive apparatus (9) consists of a feed screw apparatus (8) and servomotor (7), the movement amount alteration means (23) is composed of a control means (21) for a servomotor (7) etc.

Due to the composition of this punch drive apparatus, the first lever (11) is linked to between the base end and the free end of the second lever (12). And also, as the second lever (12) is made to pivot by the movement drive apparatus (9), due to the principle of leverage, the drive force of the movement drive apparatus (9) is increased and transmitted to the first lever (11) for the ram drive. Therefore, by means of this simple system, a large punch strength can be easily obtained.

In the case where the movement drive apparatus (9) comprises the servomotor (7) and the feed screw apparatus (8), there is no need for the intervention of a complicated transmission system like a crank system or a speed reduction gear and, due to the composition and the simplification, the cost of the apparatus can be reduced. As the feed screw apparatus (8) itself works as a power increase system or speed reduction system, coupled with the structure that drives the second lever (12) by the principle of leverage, a smaller servomotor (7) can produce greater power for the punch.

In the case where the movement amount can be changed by the movement drive apparatus (9), for example when the tool is changed, the ram (1) is lifted high up and, in order to increase the hit rate when driving the punch, it is possible to control the setting of the raised stand-by position of the ram (1) to a point lower than the top dead center of the normal stroke. In this case, when the movement drive apparatus (9) comprises the aforementioned servomotor (7) and feed screw apparatus (8), simply by being able to alter the rotational rate of the servomotor (7), the movement amount of the ram (1) can be changed and it is not necessary to attach special system parts.

DETAILED DESCRIPTION OF THE PREFERRED EMBODIMENT

Figure 1:
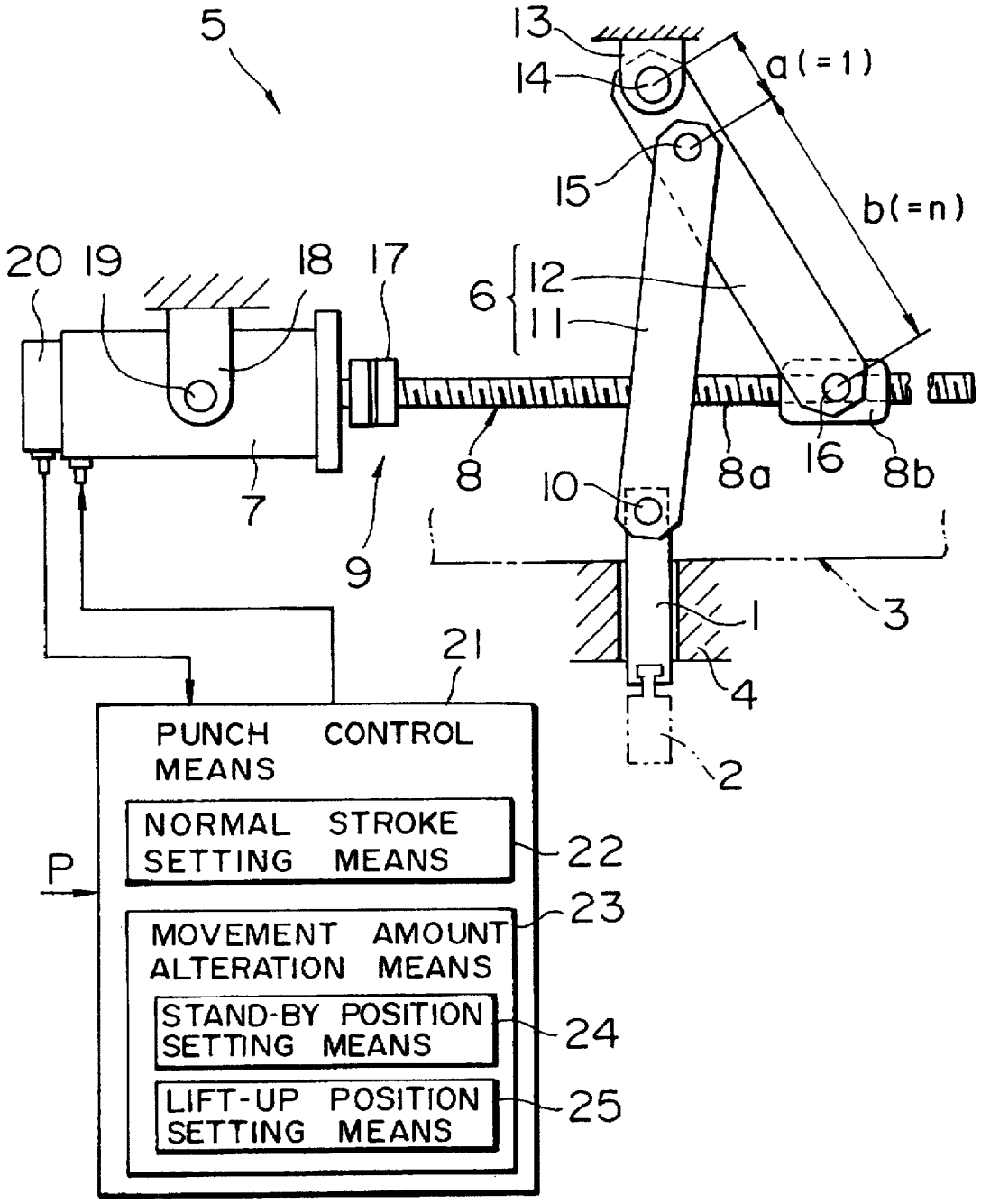
FIG. 1 is a structure explanation drawing showing a side elevation of the punch drive apparatus and a block diagram pertaining to the control means related to the embodiment of this invention.

The embodiment of this invention will be explained with respect to FIGS. 1 and 2. The ram (1) operates to drive the punch tool (2) up and down by its lower end and is supported by the guide member (4) in the press frame (3) so that the ram moves freely in an upward and downward direction. The punch drive apparatus (5) that lifts and drops the ram (1) comprises the toggle system (6) and the movement drive apparatus (9).

The toggle system (6) is formed by a first lever (11) and a second lever (12). The upper end of the ram (1) is linked to the lower end of the first lever (11) being freely pivotable by the use of a pin (10). The second lever (12) is pivotally supported at its upper end by the point support member (13) positioned on the press frame (3) by the pivot shaft (14) so that the second lever can pivot freely. The second lever is linked to the upper end of the first lever (11) between its base end and free end by a pin (15) so that it can pivot freely. The rotating support shaft (14) is positioned directly above the ram (1). The length (a) from the center of the rotating support shaft (14) of the second lever (12) to the point of linking with the first lever (11), and the length (b) from this linking point to the linking point of the movement drive apparatus (9) of the play end is set to the ratio 1:n.

The movement drive apparatus (9) comprises the servomotor (7) and the feed screw apparatus (8) and is linked to the free end of the second lever (12) and adjusts the position of the linking point of the second lever (12). The feed screw apparatus (8) comprises the screw shaft (8*a*) and the nut (8*b*) and the nut (8*b*) is attached to the free end of the second lever (12) by a pin (16) so that the second lever is freely rotatable. The feed screw apparatus (8) uses a ball screw in this embodiment but a normal sliding contact screw can be used. The screw shaft (8*a*) is connected to the motor axis of the servomotor (7) by the shaft coupling (17). The servomotor (7) is supported by the motor frame (18) which is positioned on the press frame (3) by a support shaft (19) so that it can freely pivot in an upwards and downwards direction. The servomotor (7) has a position detection device (20) composed of a pulse coder, etc.

The punch control means (21) is a means that carries out control of the servomotor (7) and is comprised of one part of a computer-type numerical control (NC) apparatus and a servo-controller. The normal stroke setting means (22) and the movement amount alteration means (23) operate as part of the punch control means (21), and the stand-by position setting means (24) and the lift-up position setting means (25) form part of the movement amount alteration means (23). The structure and functions of these means (21–25) will be explained later in the areas of overall operation.

Figure 2:
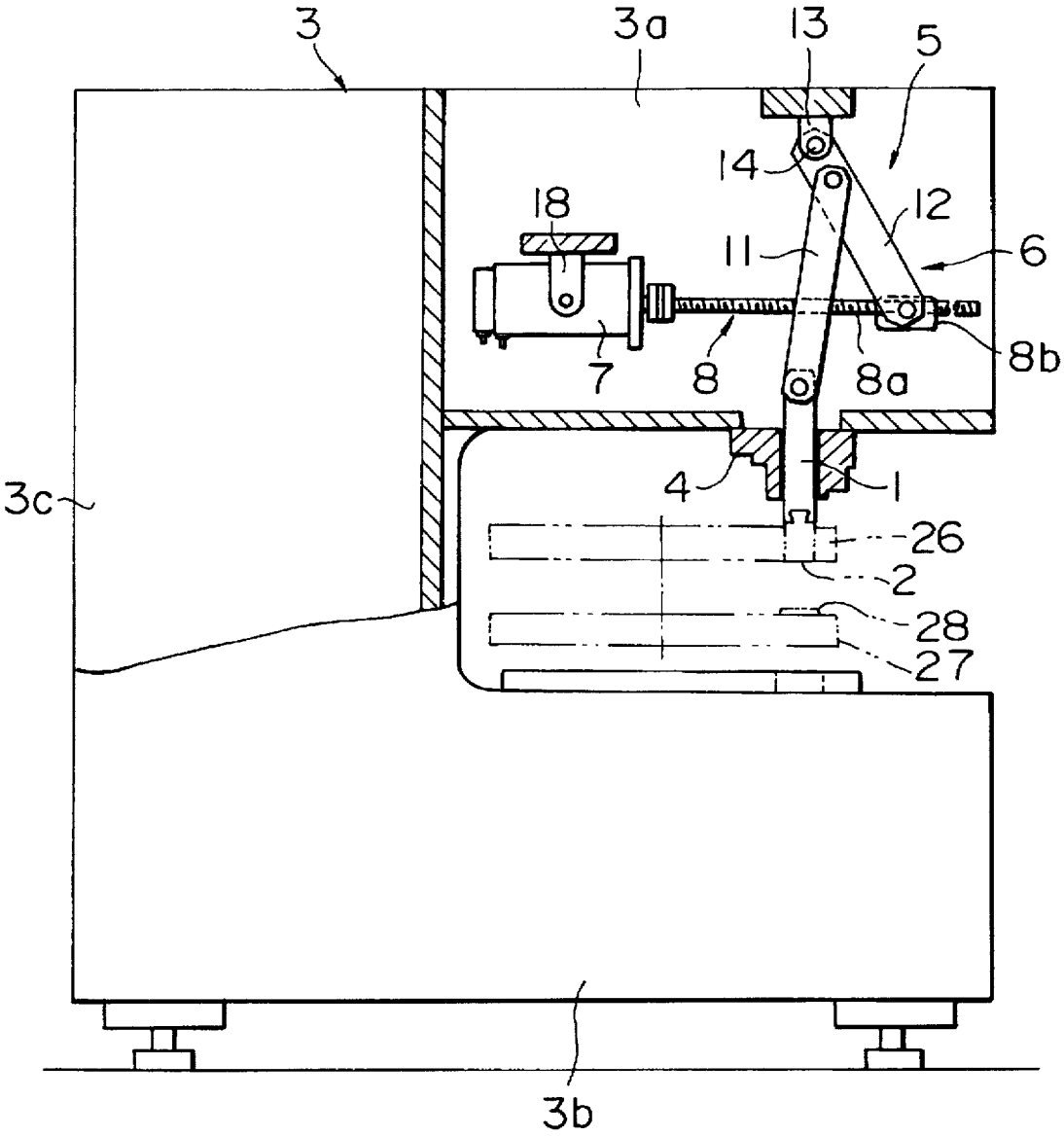
FIG. 2 is a broken sectional side elevation of a punch press employing the punch drive apparatus of FIG. 1.

FIG. 2 shows an example of the turret-type punch press equipped with this punch drive apparatus (5). The press frame (3) is comprised of a "C" shaped structure comprising the upper frame part (3*a*), the lower frame part (3*b*) and the throat part (3*c*) and the upper and lower turrets (26, 27) are supported in a concentric position being freely rotatable on the upper and lower frames (3*a*, 3*b*). These turrets (26, 27) are arranged with a plurality of punch tools (2) and die tools (28) in a circle, and are made to rotate in synchronism. The punch drive apparatus (5) is positioned in the upper frame (3*a*).

The actions of the aforementioned system will be explained.

When the servomotor (7) rotates, the nut (8*b*) of the feed screw apparatus (8) moves and, due to this movement, the second lever (12) pivots about the pivot support shaft (14). In association with this pivotal movement, the first lever (11) is made to pivot and the ram (1) linked to the bottom end of the first lever (11) moves upwards or downwards. In short, as the second lever (12) pivots downwards from the position on the right, as seen in FIG. 1, to a neutral position directly below the pivot support shaft (14), the ram (1) drops. If the second lever (12) then passes this neutral angle and moves to the left, as seen in FIG. 1, the ram (1) rises. Due to this, when the servomotor (7) rotates in the opposite direction and the second lever (12) is rotated in the opposite direction within a predetermined angle range, due to one complete rotational movement of the second lever (12), the ram (1) rises and drops two times for every one predetermined stroke. Due to the rising and dropping of this ram (1), a punch process is carried out by the punch tool (2). The second lever (12) can even pivot to only one side from neutral angle.

According to the punch drive apparatus (5) of this system, as the first lever (11) is linked to the second lever (12) between the base end and free end of the second lever (12) and because of the movement of the nut (8*b*) linked to the free end, the drive force of the nut (8*b*) from the servomotor (7) is transmitted and increased by the principle of leverage to the first lever (11). In short, as the ratio of lengths a:b is 1:n, the driving force is increased "n" times. This increased power is transmitted to the ram (1). As a result, by the system of simply lengthening the second lever (12), a large punch power can easily be obtained.

Also, the rotation of the servomotor (7) is transferred to the second lever (12) via the feed screw apparatus (8) and, as this feed screw apparatus (8) itself acts as a power increasing system or speed reducer, a larger punch power can be obtained with a smaller servomotor (7) in conjunction with the construction of the driving of the second lever (12) by the principle of leverage. Moreover, there is no need for complicated transmission systems, such as a crank system or speed reduction gear, and thus a simpler, lower cost structure is possible. Also, due to this, it is possible to use a smaller punch drive apparatus (5) and thus easily contain the whole body within the press frame (3). By using the servomotor (7) as a drive source, mid-stroke speed control is simple and quiet, high speed punching can be achieved.

In the case where, for example, a punch tool (2) is to be exchanged from the turret (26), when it is necessary to raise the punch tool (2) high up, it is only necessary for a large stroke of the feed screw apparatus (8) to be effected at the time. In short, in contrast to when a crank system, etc., is used, by simply changing the rotation amount of the servomotor (7), the bend angle of the toggle system (6) and the up-down stroke of the ram (1) can be freely changed. Because of this, there is no necessity for special parts enabling stroke alteration and release operation of the ram (1), etc., thus the structure is simplified.

The punch control means (21) of FIG. 1 is a control means enabling each kind of this control. In short, the normal stroke setting means (22) is a memory means which sets the rotation angle of the servomotor (7) that corresponds to the top or bottom dead center of the ram (1) when normal punch operation is occurring. Normally, due to the punch instruction (P) from the processing program, revolution of the drive shaft 8*a* is carried out until the aforementioned set rotation angle is obtained. In the case where the second lever (12) is pivoted past both sides of the neutral position, the rotation angle of both the time of reverse rotation and the time of ordinary rotation at top dead center is set.

The movement amount alteration means (23) is a means for causing rotation of the servomotor (7) at a rotation angle different from the normal ram stroke on an instruction from the processing program or a manual entry. The motor rotation angle in the case where the raised stand-by position of the ram (1) is set lower than the normal stroke top dead center, like for example when a nibbling process is carried out, is set in the stand-by position setting means (24). The hit rate can be increased by driving the ram (1) within the stroke distance corresponding to the set motor rotation angle. The lift up stand-by position setting means (25) is a means that sets the position that raises the ram (1) high up by the rotation angle of the servomotor (7) when exchanging tools. When exchanging tools, by lifting high up the ram (1), the punch tool (2) is lifted until a position where the turret (26) can be rotated. Then, after the lifting of the punch tool (2), the turret (26) is rotated and a different punch tool is exchanged. In the case where a predetermined raising stand-by instruction is given to the punch control means (21), the servomotor (7) is driven to that setting position.

Furthermore, this punch drive apparatus puts the principle of leverage to use on the driving of the second layer (12) by the feed screw apparatus (8), but concerning the proportionate length "n" of the second lever (12), it is necessary to choose the most suitable conditions corresponding to motor cost, time for one stroke, lead of the feed screw and motor capacity etc.

On this invention, the first lever (11) for ram drive use is linked to between the base end and free end of the second lever (12), and as the punch drive apparatus pivots the free end of the second lever (12) by the movement drive apparatus (9), a simple structure with a large punch power can be obtained.

In the case where the movement drive apparatus (9) comprises the servomotor (7) and the feed screw apparatus (8), the number of parts becomes fewer, the structure can be made simpler and, moreover, due to the control of the servomotor (7), a control of speed change can be performed mid-punch stroke and quiet, high speed punching can be performed.

In the case where movement amount of the movement drive apparatus (9) can be altered, for example when exchanging tools, the ram (1) can be raised high up and an operation to increase the hit rate and set the ram (1) raised stand-by position lower than the top dead center of the normal stroke can be carried out.

What is claimed is:

1. A punch drive apparatus for reciprocating a ram through a full cycle between an extended and a retracted position comprising:

a punch;

a linearly, movable ram operatively connected to said punch;

a first lever having one end pivotally connected to said ram;

a second lever pivotally connected at one end to a pivot support disposed substantially in-line with said ram; and a movement drive apparatus containing means operatively connected to the other end of said second lever for pivotally moving said second lever about said pivot support so that said other end of said second lever moves between both sides of a line extending between said ram and said pivot support during a full cycle of the reciprocation of said ram, and the other end of said first lever being pivotally connected to said second lever intermediate said pivot support and said other end of said second lever.

2. A punch drive apparatus as in claim 1 wherein the said movement drive apparatus comprises a servomotor and a feed screw apparatus which is attached to the other end of said second lever by a nut and is linked to said servomotor by a screw shaft.

3. A punch drive apparatus as in claims 1 or 2 wherein a movement amount alteration means is arranged which changes the movement amount of the said movement drive apparatus.

* * * * *